US011014349B2

(12) United States Patent
Dedic et al.

(10) Patent No.: US 11,014,349 B2
(45) Date of Patent: May 25, 2021

(54) METHOD AND DEVICE FOR DOUBLE-SIDED PRINTING TO A RECORDING MEDIUM

(71) Applicant: Océ Holding B.V., Venlo (NL)

(72) Inventors: Revdin Dedic, Markt Schwaben (DE); Joachim Samweber, Eichenau (DE); Christoph Soldner, Munich (DE); Oliver Stendel, Poing (DE)

(73) Assignee: Canon Production Printing Holding B.V., Venlo (NL)

( * ) Notice: Subject to any disclaimer, the term of this patent is extended or adjusted under 35 U.S.C. 154(b) by 0 days.

(21) Appl. No.: 16/518,268

(22) Filed: Jul. 22, 2019

(65) Prior Publication Data

US 2020/0023634 A1 Jan. 23, 2020

(30) Foreign Application Priority Data

Jul. 23, 2018 (DE) ..... 10 2018 117699.6

(51) Int. Cl.
*B41F 23/04* (2006.01)
*B41F 23/08* (2006.01)

(52) U.S. Cl.
CPC ..... *B41F 23/0486* (2013.01); *B41F 23/0483* (2013.01); *B41F 23/08* (2013.01)

(58) Field of Classification Search
CPC .. B41F 23/0486; B41F 23/0483; B41F 23/08; F26B 3/00; F26B 3/32; F26B 3/347; F26B 9/00; F26B 21/00; F26B 13/10; F26B 13/20
USPC ..... 34/255
See application file for complete search history.

(56) References Cited

U.S. PATENT DOCUMENTS 2,226,319 A * 12/1940 Offen ..... F26B 21/10 101/211
2,666,994 A * 1/1954 Dungler ..... F26B 13/10 34/545
4,125,948 A * 11/1978 Hering, Jr. ..... F26B 13/10 34/655

(Continued)

FOREIGN PATENT DOCUMENTS

DE 20 2005 011 939 U1 10/2005
DE 102018117699 A1 * 1/2020 ..... F26B 13/104

(Continued)

OTHER PUBLICATIONS

German action dated Mar. 15, 2019, Application No. 10 2018 117 699.6.

*Primary Examiner* — Stephen Gravini
(74) *Attorney, Agent, or Firm* — Schiff Hardin LLP

(57) ABSTRACT

In an method for double-sided printing to a recording medium, a first side of the recording medium is printed to with a liquid first color separation, the liquid first color separation is pre-dried such that a predetermined final drying state remains unachieved, where the pre-dried state is a transportable intermediate state that is between a wet print image directly after printing and the predetermined final drying state, a second side of the recording medium is printed to with a liquid second color separation, and the pre-dried first color separation and the second liquid color separation are jointly dried to entirely achieve the predetermined final drying state for both the first and second color separations.

19 Claims, 6 Drawing Sheets

(56) References Cited

U.S. PATENT DOCUMENTS 4,584,939 A * 4/1986 Giori ..... B41F 11/02 101/152
5,237,755 A * 8/1993 Lowe ..... F26B 3/347 34/255
6,155,726 A * 12/2000 Ishikawa ..... B41J 2/473 355/27
6,185,839 B1 * 2/2001 Kholodenko ..... H01J 37/3244 34/210
6,192,599 B1 * 2/2001 Bryant ..... F26B 3/347 34/255
7,244,465 B2 * 7/2007 Kondou ..... F26B 13/10 34/448
8,256,345 B2 * 9/2012 Denninger ..... B41F 7/12 101/424.1
8,798,780 B2 * 8/2014 Menchik ..... B41J 2/17513 700/119
9,327,524 B1 * 5/2016 Yamada ..... F26B 13/00
9,381,736 B2 * 7/2016 Landa ..... B41M 5/0256
10,240,864 B2 * 3/2019 Uesaka ..... F26B 3/283
10,458,068 B2 * 10/2019 Lu ..... D21H 23/10
2008/0172903 A1 * 7/2008 Shimoda ..... F26B 13/10 34/423
2009/0241365 A1 * 10/2009 Taguchi ..... F26B 21/004 34/389
2019/0264384 A1 * 8/2019 Chung ..... D06P 1/16
2019/0382608 A1 * 12/2019 Mozel ..... D06P 1/0096
2020/0023634 A1 * 1/2020 Dedic ..... B41F 23/08
2020/0274110 A1 * 8/2020 Chen ..... H01L 51/0018

FOREIGN PATENT DOCUMENTS

EP 2105690 A2 * 9/2009 ..... F26B 13/10
EP 1938952 A3 * 8/2012 ..... B33Y 50/02
JP 2009236355 A * 10/2009 ..... F26B 13/10
WO WO-2004044816 A1 * 5/2004 ..... G01G 17/06
WO WO-2017142511 A1 * 8/2017 ..... D21H 17/64

* cited by examiner

METHOD AND DEVICE FOR DOUBLE-SIDED PRINTING TO A RECORDING MEDIUM

CROSS REFERENCE TO RELATED APPLICATIONS

This patent application claims priority to German Patent Application No. 102018117699.6, filed Jul. 23, 2018, which is incorporated herein by reference in its entirety.

BACKGROUND

Field

The disclosure relates to a method for double-sided printing to a recording medium, as well as to a device for double-sided printing to a recording medium.

Related Art

Given printing methods with liquid color separation, there always exists a problem of drying the color separation before it loses quality due to a further transport or a further processing of the recording medium. Dryers are therefore used, in particular given what are known as high-capacity printing methods. The most diverse solution approaches exist for this, depending on the printing method.

What are known as simultaneous duplex printing methods exist, for example for rolling offset (heatset) printing, which print simultaneously to the front side and back side. The recording medium is then directly dried in a dryer.

In particular in inkjet printing methods, however, the two sides of a recording medium are not printed to simultaneously, but rather individually in sequence. The individual color separations thus must also be dried individually. For this purpose, two separate printing towers are provided which are of identical design with regard to one another and which print to and dry both sides of a recording medium independently of one another.

BRIEF DESCRIPTION OF THE DRAWINGS/FIGURES

The accompanying drawings, which are incorporated herein and form a part of the specification, illustrate the embodiments of the present disclosure and, together with the description, further serve to explain the principles of the embodiments and to enable a person skilled in the pertinent art to make and use the embodiments.

Figure 1:
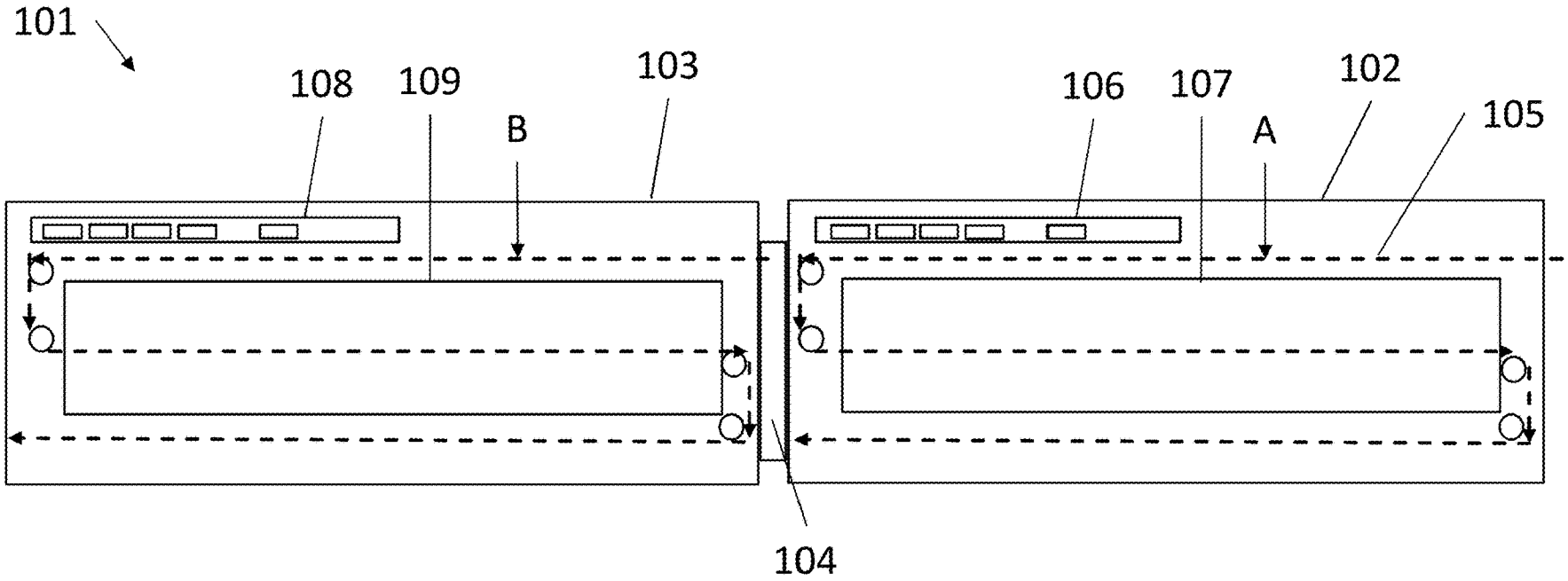
FIG. 1 is a schematic depiction of an example printing device.

The exemplary embodiments of the present disclosure will be described with reference to the accompanying drawings. Elements, features and components that are identical, functionally identical and have the same effect are—insofar as is not stated otherwise—respectively provided with the same reference character.

DETAILED DESCRIPTION

In the following description, numerous specific details are set forth in order to provide a thorough understanding of the embodiments of the present disclosure. However, it will be apparent to those skilled in the art that the embodiments, including structures, systems, and methods, may be practiced without these specific details. The description and representation herein are the common means used by those experienced or skilled in the art to most effectively convey the substance of their work to others skilled in the art. In other instances, well-known methods, procedures, components, and circuitry have not been described in detail to avoid unnecessarily obscuring embodiments of the disclosure.

An object of the present disclosure is to provide an improved method and a corresponding device for double-sided printing to a recording medium.

An example printing device 101 is schematically depicted in FIG. 1. A first printing tower 102 and an identical second printing tower 103 are connected to one another in series. Arranged between the printing towers 102, 103 is a turner 104. A recording medium 105 initially passes through the first printing tower 102, and therein is printed to on a first side A with a color separation at a printing station 106, which color separation is dried in a subsequent drying station 107. The recording medium therefore leaves the first printing tower 102 with a predetermined drying state of the color separation that is suitable for a further processing of the recording medium 105. The recording medium is then turned in the turner 104 and supplied to the second printing tower 103. The second printing tower 103 likewise has a printing station 108 and a drying station 109 which are designed identical to the printing station 106 and the drying station 107 of the first printing tower. Here, the second side B of the recording medium is thus printed to with a color separation which is likewise dried with a subsequent drying station 109 in the predetermined drying state.

In an exemplary embodiment, a method for double-sided printing to a recording medium includes printing to a first side of the recording medium with a liquid first color separation; pre-drying of the first color separation, wherein a predetermined final drying state remains unachieved; printing to a second side of the recording medium with a liquid second color separation; and joint drying of the first and second color separation, wherein the first and second color separation respectively entirely achieve the predetermined final drying state.

In an exemplary embodiment, a device for double-sided printing to a recording medium includes a first printing tower which has a first printing station for printing to a first side of the recording medium with a first color separation, and a first drying station for pre-drying of the first color separation; and a second printing tower which has a second printing station for printing to a second side of the recording medium with a second color separation, and a second drying station for joint drying of the first color separation and the second color separation; wherein the first drying station has a different design than the second drying station, and is designed such that a predetermined final drying state, which is respectively entirely achieved for the first and second color separation with the second drying station, remains unachieved via the pre-drying of the first color separation. In one or more aspects, the device for double-sided printing to a recording medium is configured to perform the method of double-sided printing according to one or more exemplary embodiments described herein.

The inventors have realized that a full robustness or final robustness of the first color separation on the first side is not necessary for a further transport and for printing to a second side. Rather, a pre-dried intermediate state which allows the color separation to be sufficiently robust for the transport (transport-robust) to a second printing tower, but not sufficiently robust for a takeup or a further processing of the recording medium, i.e. not finally robust, is also sufficient for these purposes.

According to one or more exemplary embodiments, only an incomplete pre-drying is provided after the printing to the first side of the recording medium. In an exemplary embodiment, the incomplete pre-drying is sufficiently robust for the further transport of the recording medium and for printing to the second side, but does not entirely achieve a predetermined final drying state that would be necessary for takeup or for further processing of the recording medium. The pre-dried state is thus a transport-robust intermediate state which lies between a wet print image directly after printing and the predetermined, final drying state. For example, a certain proportion of the solvent of the color separation may be removed in the pre-drying in order to achieve a higher viscosity which is sufficient for the required transport-robustness.

For the first color separation, the pre-dried state thus offers a sufficient transport-robustness for a transport within the device, so that a smearing and/or depositing of the color on components of the printing machine (for example deflection and/or drive rollers) is avoided. However, a sufficient final robustness for taking up or further processing the recording medium is not yet achieved. According to the disclosure, the final robustness of the first color separation is only achieved with the predetermined final drying state, via the joint drying following the printing to the second side with the second color separation. For example, for this purposes the solvent is entirely evaporated upon drying, and/or is absorbed or penetrates via diffusion into the recording medium. Cross-linking reactions or film formation are also conceivable.

The more strongly that the first color separation is pre-dried, the more resistant it is to wear due to transport and/or deflection elements. The robustness of the first color separation thus depends on its drying state. A robustness that is sufficient for transport is thereby also dependent on the condition, in particular the surface, of the transport, drive, and/or deflection elements, and may be designed so as to be adapted thereto.

A complete drying to achieve a final robustness of the first color separation is thus only achieved via the joint drying after the printing of the second color separation, wherein the first pre-dried color separation and also the second fresh or wet color separation are completely dried to achieve the predetermined drying state.

According to the disclosure, in the pre-drying a drying effort is made that is only sufficient to reach the joint drying without damage. By contrast, the drying effort that is spent anyway to dry the second color separation is used as well for the complete drying of the first color separation. According to the disclosure, two printing and drying processes that are independent of one another are thus no longer used for the printing to the first and second side. Rather, the two processes are now matched to one another with regard to the drying progress. In this way, according to the disclosure the energy that is necessary for drying the second color separation can be synergistically also used further for the complete drying of the first color separation, whereas markedly less energy, and also a markedly smaller installation space, is required for pre-drying of the first color separation. Markedly lower maximum temperatures than are necessary for complete drying are necessary for pre-drying. Moreover, a maximum temperature also does not need to be held, or must at least be held for a markedly shorter amount of time, for pre-drying. In this way, a lower heating capacity is required. Furthermore, energy is saved in that a cooling that is necessary for the further printing to the second side of the recording medium also requires a lower cooling capacity due to the lower maximum temperature. In addition to this, a first drying station for pre-drying may be of markedly more compact design than a drying station provided for complete drying. Both a heating path and a cooling path may be of shorter design due to the smaller temperature differences that are to be achieved. Moreover, the second drying station for the joint drying is sufficient with an identical length and an identical energy expenditure as would be necessary for the complete drying of only the second color separation. Overall, the installation space saved in the first drying station and the energy saved in the first drying station are also saved collectively. In addition to this, the smaller installation space leads to an additional indirect energy savings effect, because high-capacity printing machines are typically charged with a negative pressure in order to prevent an emission of vapors. With smaller installation space, a volume flow to be discharged to develop a corresponding negative pressure in the first printing tower is reduced, so that less energy needs to be expended for the exhaust air. Moreover, devices according to the disclosure, in particular for high-capacity printing, for the reduction of influencing variables are often operated in a climate-controlled environment, or methods according to the disclosure are implemented in a climate-controlled environment, so that energy that is expended for the climate-control of the environment is also simultaneously reduced given an exhaust air volume flow that is reduced due to the installation space that is saved.

In further embodiments, the installation space that is saved in the first drying station, and/or the energy saved in the first drying station, may also be used at least in part in order to extend, in the second drying station, a hold duration of the maximum drying temperature, which is particularly effective for complete drying. A longer hold duration does in fact again require more installation space for the second drying station, such that the installation space savings turns out to be smaller overall, or is compensated. However, markedly less energy is required to hold the temperature than to adjust the temperature. Via this synergy effect, in comparison to a conventional drying station, a drying state of the first and second color separation that can be achieved with the second drying station can thus be increased, or the same drying state can be achieved at a higher printing speed, and nevertheless energy is saved overall.

As an additional advantage of the disclosure, the energy input that is lower overall is gentler to the recording medium, such that overall less thermal stress is exerted on the recording medium. It is thus avoided that the recording medium, for example a paper, dries out strongly due too high an introduced heating power and/or too long a residence time, which may have a negative effect on the following printing process, and therefore the quality of the print image to be produced.

The present disclosure relates in particular to a method and a device for what is known as high-capacity printing, preferably with a feed velocity of the recording medium of greater than 20 meters per minute.

Although a first and second printing tower, or a first and second color separation, are always discussed with regard to the present disclosure, more than two printing towers and/or more than one color separation may of course be provided per side. For example, it would be conceivable to provide 4 color separations on each side, according to the YMCK color model with the color components cyan, magenta, yellow, and key (black portion). In principle, this would be conceivable both at a common printing station and/or at various printing stations. The color separations of the first side may thus be pre-dried individually or jointly. The same applies to the color separations of the second side. The final, joint drying for the production of the predetermined drying state is always performed after a last color separation of the second side.

The present disclosure is also not limited to inkjet printing, but rather is applicable to numerous printing methods in which the two sides of a recording medium are printed to individually in succession, or sequentially, with liquid color separation.

The embodiments and developments of the disclosure can be arbitrarily combined with one another, insofar as is reasonable. In particular, all features of the method for double-sided printing to a recording medium can be transferred to a device for double-sided printing to a recording medium, and vice versa.

Additional possible embodiments, developments, and implementations of the disclosure include combinations of features of the disclosure that are described in the preceding or in the following with regard to the exemplary embodiments, even if said combinations are not explicitly cited. In particular, the person skilled in the art will thereby also add individual aspects as improvements or extensions to the respective basic form of the present disclosure.

Figure 2:
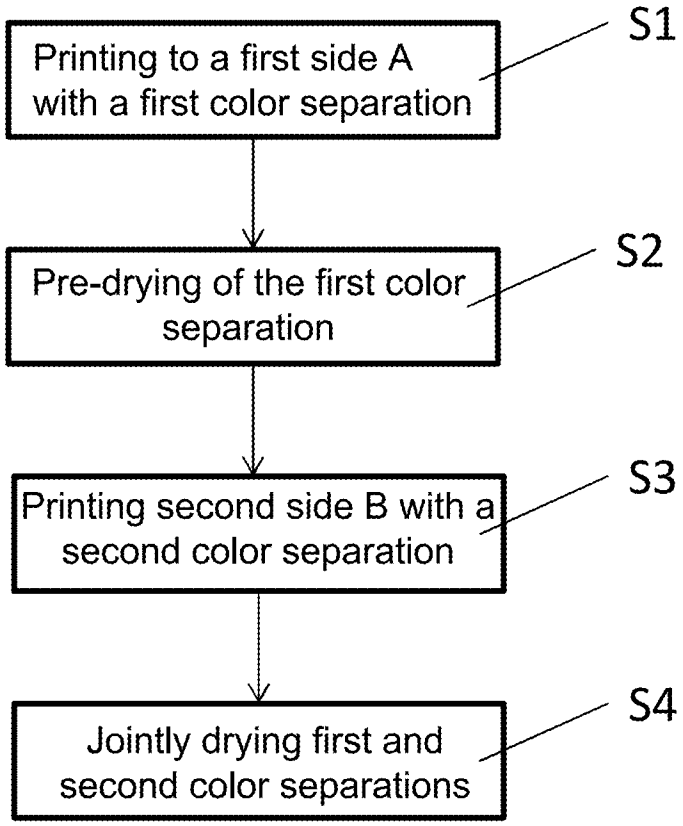
FIG. 2 is a schematic workflow diagram of a method according to an exemplary embodiment.

FIG. 2 shows a schematic workflow diagram of a method according to the disclosure.

The method is provided for double-sided printing to a recording medium 2. A first step of the method involves the printing S1 to a first side A of the recording medium 2 with a liquid first color separation. A second step includes the pre-drying S2 of the first color separation, wherein a predetermined final drying state remains unachieved. A third step includes the printing S3 to a second side B of the recording medium 2 with a liquid second color separation. A fourth step of the joint drying S4 of the first and second color separation is also provided, wherein the first color separation and the second color separation respectively achieve the predetermined final drying state.

The printing may respectively be performed with a printing method which generates a liquid color separation. For example, it may be inkjet printing, digital liquid toner printing, offset printing, or the like.

The predetermined final drying state is preferably what is known as a final robust state in which the recording medium 2 may be taken up or processed further. After the pre-drying S2, in which this drying state is only incompletely achieved, the recording medium may not yet be arbitrarily processed further; however, it is sufficiently touch-safe or transport-robust for further transport up to the joint drying S4.

According to one embodiment, the recording medium 2 is transported and/or deflected with a transport device 19 following the pre-drying S2. In particular, the transport device may have transport or deflection rollers 3. The pre-drying S2 prepares the first color separation to be touch-safe for the transport and/or deflection. A touch-safe, pre-dried state that can be achieved in this way and that lies between a completely dried state and a wet or liquid state of the color separation is referred to as "transport-robust". The transportation and/or deflection of the recording medium in a pre-dried state of the first color separation is thus enabled without loss of quality. According to one embodiment, the recording medium 2 is turned with a turner 4 between the pre-drying S2 and the printing S3 of the second side B. The pre-drying 2 thereby prepares the first color separation for the turning. The turning of the recording medium in the pre-dried state of the first color separation is thus enabled without loss of quality.

According to one embodiment, the predetermined final drying state is provided or set such that the first color separation and the second color separation are sufficiently robust for a takeup of the recording medium. The sufficient robustness in particular allows a takeup of the color separation without color loss or adhesion of the first color separation (what is known as blocking). Alternatively or additionally, the first and second color separation are sufficiently robust for a direct or later additional processing of the recording medium. Such an additional processing or further processing may, for example, include a cutting, folding, enveloping, bookbinding, or the like, as well as combinations thereof.

According to one embodiment, the pre-drying S2 of the first color separation includes a heating of the recording medium 2 to a predetermined minimum temperature, and the joint drying S3 of the first color separation and of the second color separation includes a heating of the recording medium 2 to a predetermined drying temperature, wherein the minimum temperature is below the drying temperature. The minimum temperature and the drying temperature depend on the type of color separation, among other things. For example, a drying temperature for high-capacity inkjet printing may be in a range from 120-150° C., and a minimum temperature may be between 100-120° C. Less heating energy is thus advantageously necessary for pre-drying, and overall energy may be saved without loss in quality.

According to one embodiment, the pre-drying S2 includes a cooling of the recording medium to a temperature suitable for printing S3, which cooling directly follows the heating of the recording medium 2 to the minimum temperature. A temperature that is suitable for printing preferably lies below 60° C., for example is between 20° C. and 60° C. Due to the lower temperature upon pre-drying, in comparison to the drying temperature, comparably less cooling capacity is also necessary for cooling. A hold period can also be omitted, such that an installation space that is necessary for holding, and the energy necessary for this, may likewise be saved.

According to the disclosure, a reduction of the total length of the device that is necessary for the method is thus achieved since a drying station for pre-drying is provided to be only so long as is necessary for transport-robustness, and does not need to have a length necessary for final robustness. With the reduced drying station, production costs for the drying stations can be reduced, and energy costs and maintenance expenses as well as a total exhaust air volume for operation can be reduced. An embrittlement or fragility of the recording medium due to too large an introduction of heat is also avoided. At the same time, the print image may be improved since too severe a drying, and negative effects on the printing capability that are possibly linked therewith, are avoided.

According to an exemplary embodiment, the joint drying S4 of the first color separation and second color separation following the heating to the predetermined drying temperature includes an intervening holding of the drying temperature, or of a predetermined temperature profile, for a predetermined duration. In this way, an achievement of the predetermined drying state is reliably achieved for both the first color separation and the second color separation.

According to one embodiment, the printing S1 to the first side A, and alternatively or additionally the printing S3 to the second side B, is performed by means of inkjet printing. In this way, a novel manner of drying is provided for the printing method of inkjet printing. In particular, the individual sides of the recording medium are not printed independently of one another in two different printing towers, and the respective color separations are not dried individually to produce a final robustness, as described with regard to FIG. 1; rather, a drying process that is integrated across the entire method is provided and is designed accordingly.

Moreover, the pre-drying S2, and alternatively or additionally the joint drying S4, may be performed by means of no-contact hot air flotation drying. A drying that is suitable for inkjet high-capacity printing, in particular with print speeds of greater than 20 meters per minute, is thus provided that avoids a smearing of the color separation.

Figure 3:
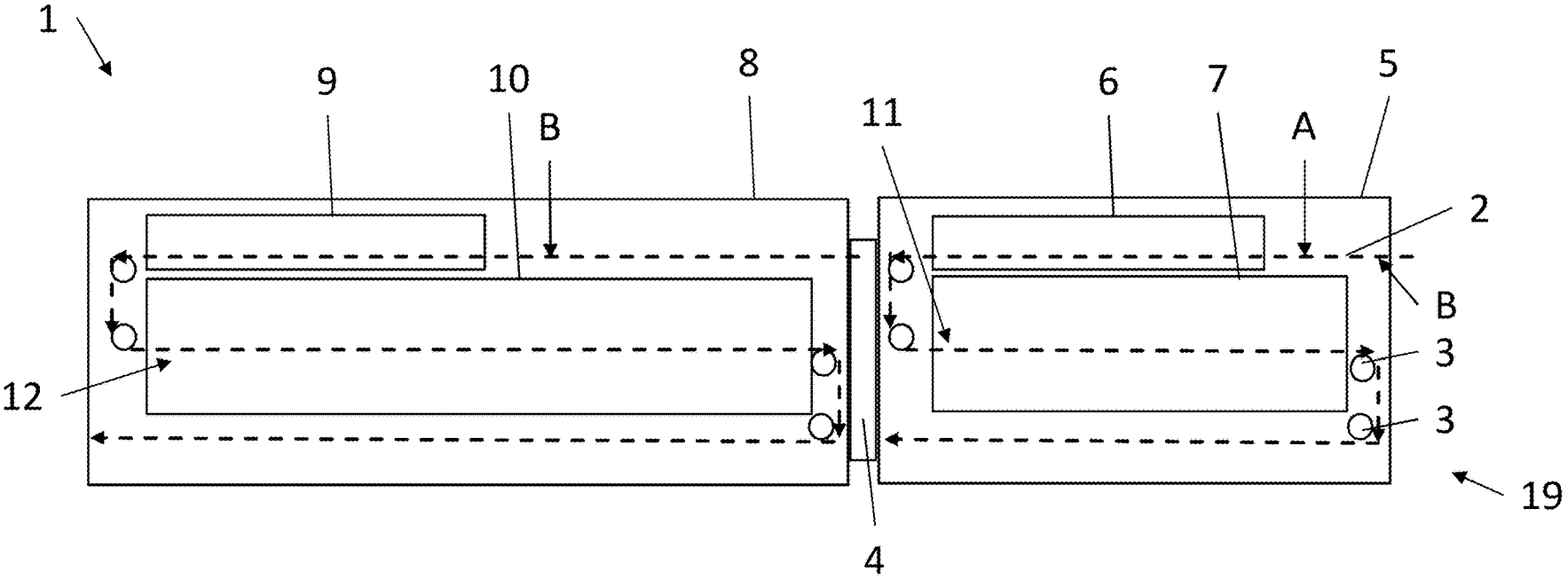
FIG. 3 is a schematic depiction of a device according to an exemplary embodiment.

FIG. 3 shows a schematic depiction of a device according to the disclosure.

The device 1 is designed for double-sided printing to a recording medium 2, and has a first printing tower 5 and a second printing tower 8. The first printing tower 5 has a first printing station 6 for printing to a first side A of the recording medium 2 with a first color separation, and a first drying station 7 for pre-drying of the first color separation. The second printing tower 8 has a second printing station 9 for printing to a second side B of the recording medium 2 with a second color separation, and a second drying station 10 for pre-drying of the second color separation. The first drying station 7 is of a different design than the second drying station 10, and is fashioned such that a predetermined drying state which is achieved with the second drying station 10 for the first color separation and second color separation is only incompletely achieved via the pre-drying of the first color separation. It is hereby a device that is provided and designed for implementation of the method described with regard to FIG. 2.

In particular, in contrast to the printing device 101 according to FIG. 1, the first and second drying station 7, 10 are not identical, but rather are of different or asymmetrical design. In this way, a different size of the printing towers 5, 8 is provided. Due to the more compact drying station 7, the first printing tower 5 here is in particular designed to be significantly more compact, preferably with a smaller total length, than the second printing tower 8.

The recording medium 2 is typically taken off of a roll (not depicted here for the sake of better clarity) and enters into the first printing tower 5 before the first printing station with a predetermined initial tension which is in particular maintained through the entire device 1. The first color separation is printed onto a first side A of the recording medium 2 in the first printing station 6.

The recording medium 2 is subsequently directed into the first drying station 7. For this, it is directed on the second side B via drive and/or deflection rollers, so that the first color separation arrives without contact in the first drying station 7 and is pre-dried there.

For this, the first drying station 7 has a first drying section 11. The second drying station 10 also has a second section 12 for the joint drying S4. The second drying section 12 is designed to be longer than the first drying section 11. The shorter first drying section 11 is sufficient for the pre-drying of the first color separation, such that this is sufficiently robust for the further transport, or transport-robust. In this way, a smearing or depositing of the color on transport elements of the device, and thus advantageously a preservation of the quality of the first color separation, is ensured. A transport-robust state that is achieved via the pre-drying S2 is provided such that the color separation or a print image may be transported further within the device 1, without information losses thereby occurring due to color particles being ripped out, and color deposits on transport elements also do not occur. In particular, for this purpose the first color separation is only heated to a minimum temperature, and is held at this minimum temperature only as briefly as is possible, or is directly cooled again, in order to provide a sufficiently high viscosity of the ink for the least robustness necessary for the transport (transport-robustness) with minimum energy expenditure, in particular at high feed velocity of greater than 20 meters per minute.

A transport device 19 is provided for transport of the recording medium 2 from the first printing tower 5 to the second printing tower 8. The first drying station 7 is therefore designed such that the recording medium 2 can be transported touch-safe (e.g. without compromising the integrity of the printing thereon) via the transport device 19 with the pre-dried first color separation. In particular, the pre-dried first color separation is thus sufficiently transport-robust for a further handling via the transport device 19.

Following the first drying station 7, the recording medium may thus also be handled for transport on the first side A.

According to an exemplary embodiment, transport device 19 has transport, drive, and/or deflection rollers 3 with predetermined surface properties. The first drying station 7 is designed for a pre-drying adapted to these surface properties, for a corresponding transport-robustness of the first color separation that is sufficient for a transport and/or deflection by means of the rollers 3.

According to an exemplary embodiment, the transport device 19 has a turner 4 between the two printing towers 5, 8. The turner 4 turns the recording medium following the first drying station 7 and before the second printing station 9. The second printing station 9 may thus print to the second side B of the recording medium 2 in the same manner as the first printing station 6 prints to the first side A of the recording medium 2. In particular, in inkjet printing, printing may thus advantageously take place in the same manner essentially with the utilization of gravity. The first drying station 7 is designed for a corresponding turning robustness of the first color separation, corresponding to a pre-drying adapted to the surface load upon turning.

After the turner 4, the recording medium 2 arrives in the turned state in the second printing tower 8, and there is printed to on the second side B with a second color separation by means of the second printing station 9. The recording medium 2 is then directed further into the second drying station 10. For this, it is directed on the first side A via drive and/or deflection rollers so that the second color separation arrives without contact in the second drying station 10. In the second drying station 10, the first color separation and the second color separation are dried jointly until both the first color separation and the second color separation have achieved a predetermined drying state. The predetermined drying state in particular satisfies the requirements of a predetermined final robustness of the color separations for takeup or for further processing of the recording medium 2. For this purpose, in particular a required drying temperature of the recording medium 2 and a required hold time at this drying temperature or a required temperature profile are set. Liquid phases (what are known as co-solvents) contained in the ink are vaporized in this way, and optionally or additionally are diffusively absorbed into the recording medium (what is known as penetration). Cross-linking reactions or a film formation may also be considered, depending on the type of colorant.

The recording medium is thus dried on both sides in the joint drying. Both the first color separation, which has already been pre-dried, and the freshly applied second color separation are thus brought into the predetermined drying state.

Following the second drying station 10, the recording medium 2 in the final robust state is directed out of the device 1.

Figure 4:
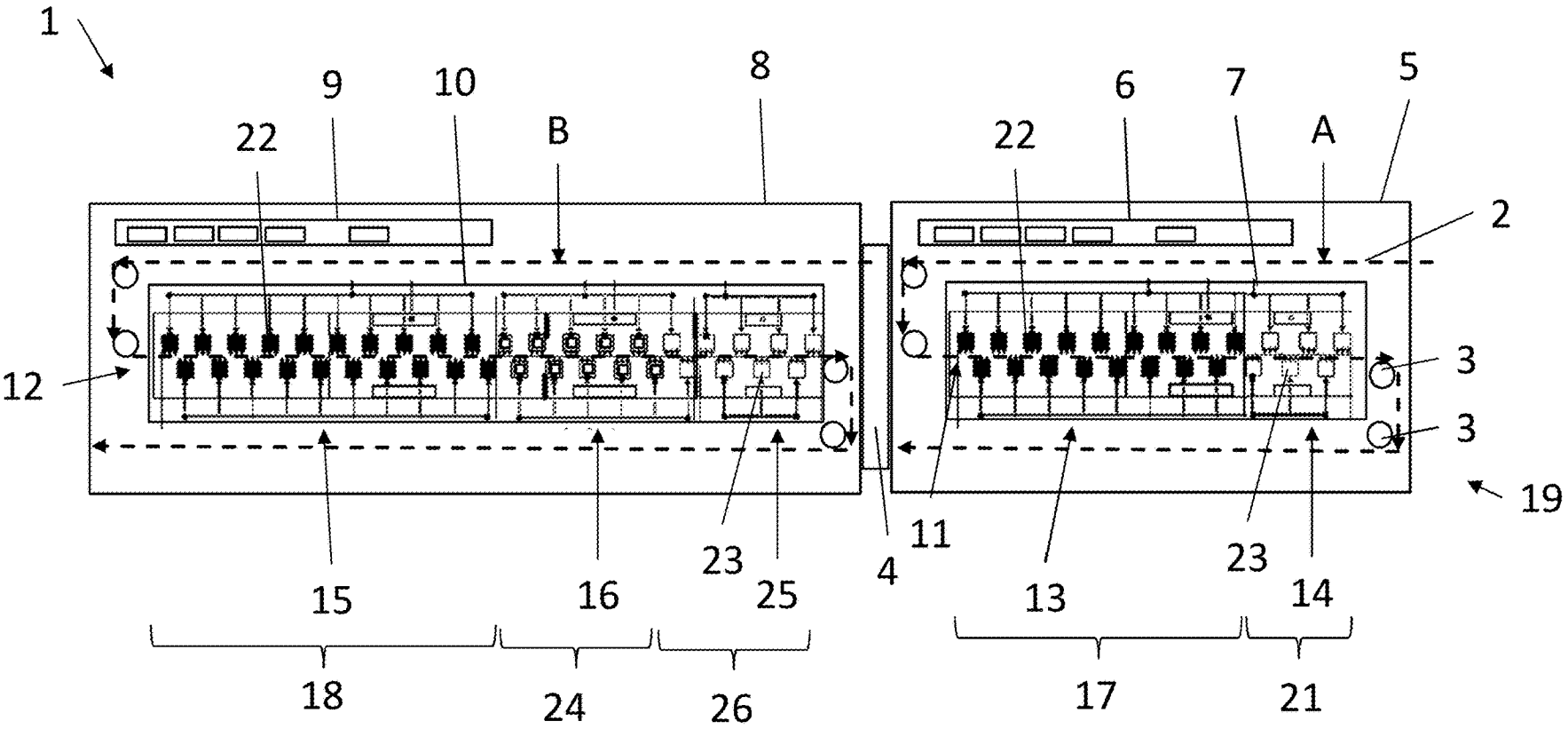
FIG. 4 is a schematic depiction of a device for double-sided printing to a recording medium according to an exemplary embodiment.

FIG. 4 shows a schematic depiction of a device 1 for double-sided printing to a recording medium 2 according to an exemplary embodiment.

In this embodiment, the first printing station 6 and the second printing station 9 are respectively depicted by way of example as YMCK inkjet printing stations which, as an example, respectively have a primer print bar P as well as color print bars Y, C, M, K. As an alternative or in addition to a primer, a different conditioning fluid may also be applied.

The recording medium initially traverses the primer print bar P as well as all color print bars Y, C, M, K, and is subsequently introduced into the first drying station 7 in the same manner as explained with regard to FIG. 3.

In this embodiment, the first drying station 7 is designed as a no-contact hot air flotation dryer, and has a first heater 13 for heating the recording medium 2 with hot air, and a directly following cooler 14 for cooling the recording medium 2 with cool air.

The heater 13 has a comparably short heating section 17 with a plurality of hot air elements 22. The heating section 17 is designed to heat the recording medium 2 to a minimum temperature sufficient for pre-drying.

The minimum temperature is sufficient to produce a transport-robust state of the first color separation. In an exemplary embodiment, a minimum temperature is in a range from 80° C. to 140° C. In an exemplary embodiment, the minimum temperature is in a range of 90° C. to 120° C. In another embodiment, the minimum temperature is in a range of 100° C. to 110° C., depending on the ink that is used. In the depicted exemplary embodiment, the minimum temperature is approximately 100° C., but is not limited thereto.

Directly afterward, the recording medium is cooled with the cooler 14 to a temperature suitable for additional printing to the recording medium which, for example lies between 20° C. and 60° C., preferably between 20° C. and 40° C., at 30° C. in the depicted exemplary embodiment. For this, the cooler 14 has a comparably short first cooling section 21 with a plurality of cooling air elements 23. Overall, a first drying section 11 of the first drying station 7 is thus comparably short.

The recording medium 2 subsequently arrives in the second printing tower 8 in the manner described with regard to FIG. 3. The second printing station 9 provided therein is designed as a YCMK inkjet printing station, just as in the first printing station 6. After the printing to the side B, the recording medium 2 is directed into the second drying station 10.

In an exemplary embodiment, the second drying station 10 differs from the first drying station 7 via a drying section 12 that is markedly longer overall. A second heater 15 for heating of the recording medium 2 to a predetermined drying temperature already has a second heating section 18 which is designed to be markedly longer than the first heating section 17. In particular, the second heater 15 has more hot air elements 22 than the first heating section 17, in order to achieve a comparably higher drying temperature. In an exemplary embodiment, the drying temperature is in a range from 120° C. to 180° C., or 120° C. to 150° C. In the depicted exemplary embodiment, the temperature is 150° C.

In contrast to the first drying station 7, the second drying station 10 has a holder 16. This defines a holding section 24 and is designed to hold the drying temperature, or a predetermined temperature profile, over a hold duration predetermined by the length of the holding section 24 and the feed velocity of the recording medium 2. In this way, a high degree of drying is achieved that corresponds to at least the predetermined final drying state for both the first and the second color separation.

Following the hold section 7, the recording medium 2 here is also cooled with a second cooler 25 to a temperature suitable for further processing of the recording medium. In an exemplary embodiment, the cooling temperature is in the range of 20° C. and 60° C., or in the range of 25° C. and 40° C. In the depicted exemplary embodiment, the temperature is approximately 30° C. Since the temperature difference to be overcome here is greater than in the first cooler 14, the second cooler 25 has a comparably long second cooling section 26 with a greater number of cool air elements 23.

Such a device 1 can advantageously by flexibly used, similar to a printing device 101 according to FIG. 1. In particular, printing to only one side, or single-sided and double-sided printing can therefore likewise be flexibly realized as needed. In this instance, only the second printing tower 8 or its printing station 9 and drying station 10 would be activated for a single-sided printing.

Figure 5:
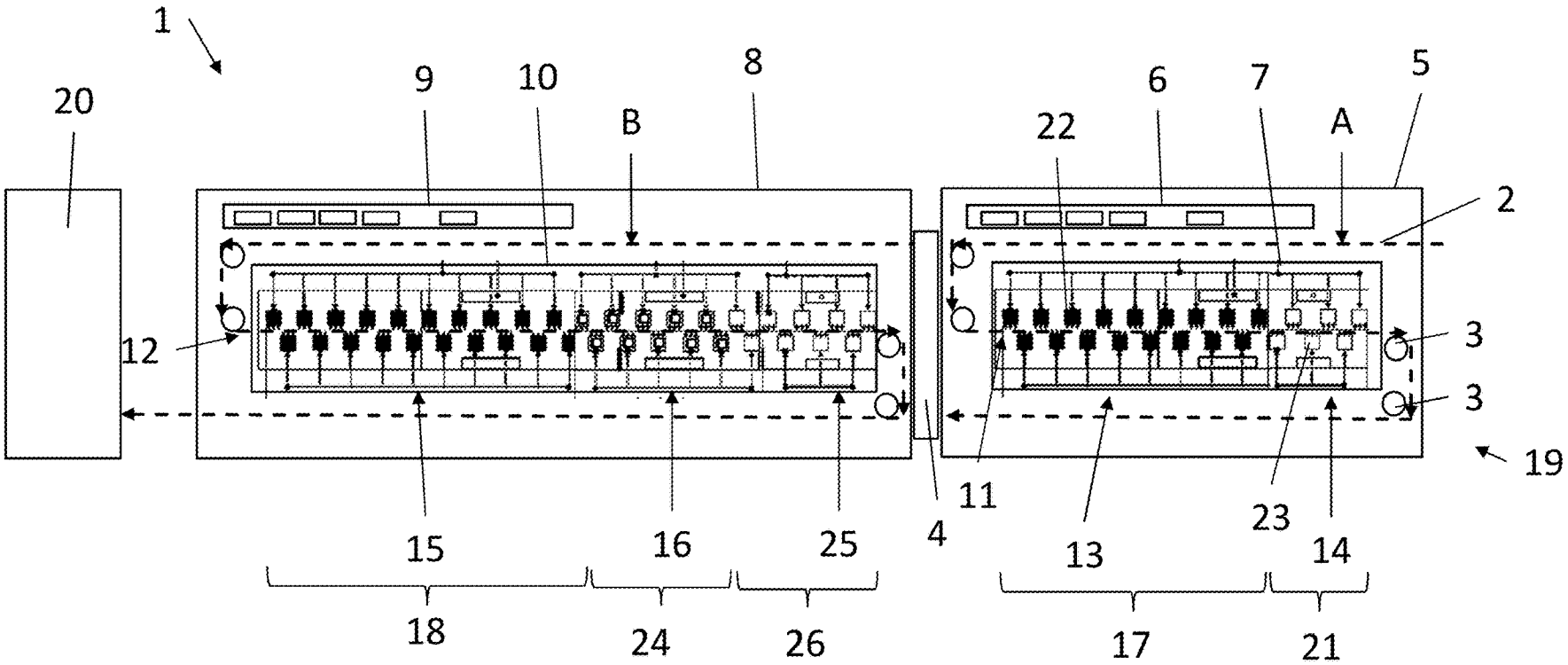
FIG. 5 is a schematic depiction of a device for double-sided printing to a recording medium according to an exemplary embodiment.

FIG. 5 shows a schematic depiction of a device for double-sided printing to a recording medium, according to an exemplary embodiment.

This embodiment differs from the embodiment according to FIG. 4 due to a takeup device and/or further processing device 20 following the second printing tower 8. The predetermined drying state of the first and second color separation that is achieved via the second drying station 10 exhibits a final robustness which is provided to be sufficient for a direct takeup, or for a direct further processing of the recording medium 2. For example, the recording medium may thus be taken up and, alternatively or additionally, for further processing may be cut, folded, enveloped, and/or bound.

Figure 6:
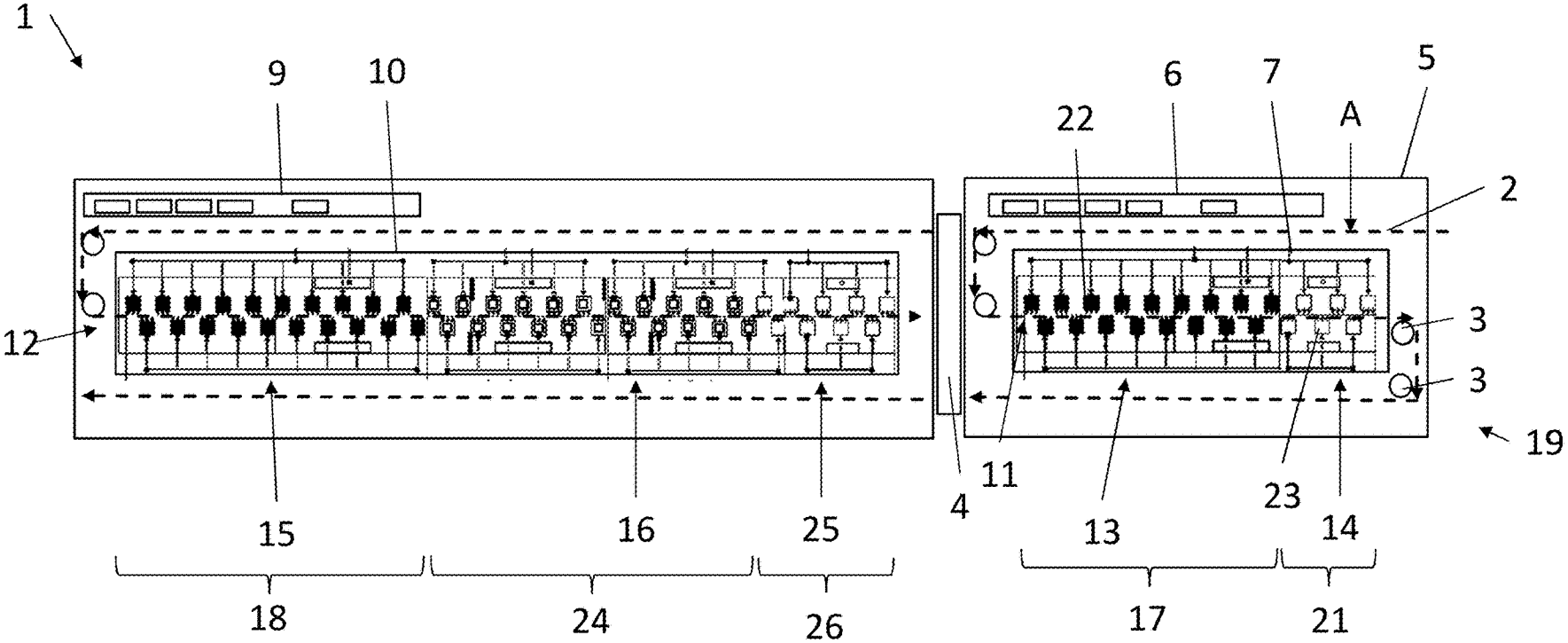
FIG. 6 is a schematic depiction of a device for double-sided printing to a recording medium according to an exemplary embodiment.

FIG. 6 shows a schematic depiction of a device for double-sided printing to a recording medium 20, according to an exemplary embodiment.

This embodiment illustrated in FIG. 6 differs from the embodiment according to FIG. 4 due to a substantially larger holding section 24 of the holder 16. Here the drying temperature, or a predetermined temperature profile, is thus held over a comparably longer hold duration. In this way, a higher degree of drying can be achieved for the first and second color separation without the first drying station 7 needing to be modified for this purpose.

In an exemplary embodiment, a total drying length, and an energy consumed in total for drying, here are not greater than they would be given two identical drying stations 107, 109 of a printing device 101 according to FIG. 1 to achieve the predetermined drying state. However, by comparison, a markedly greater degree of drying is achieved via the use, according to the disclosure, of the drying energy of the lengthened second drying station 10 for both color separations.

In the depicted embodiments, the recording medium 2 is supplied essentially horizontally, respectively deflected via rollers after being printed to, and likewise is supplied horizontally into a drying station provided under the printing station. However, other arrangements of the printing station and the drying station would of course also be conceivable, as well as different guidance of the recording medium. In particular, it would also be conceivable to provide a different design of a printing tower or of a printing section. For example, vertical guidance of the recording medium would also be conceivable as an alternative or in addition to the horizontal guidance. Optionally, or in addition to rollers, other guidance elements are also conceivable.

In the embodiments according to FIG. 4 through 6, the drying stations 7, 10 are respectively designed as hot air flotation dryers, which are essentially based on the heat conduction principle of forced convection. However, the drying stations 7, 10 are not limited to this exemplary drying technology. For example, other types of thermal transfer would also be possible wholly or in part. In an exemplary embodiment, a roller cooling based on thermal conduction would also be conceivable instead of an air current-based cooler 25. This would be realizable in particular for the first drying station 7, in which a comparably smaller temperature differential is present.

Moreover, the printing stations 6, 9 do not necessarily need to be designed as inkjet printing stations. Rather, other types of printing methods which generate a liquid color separation also come under consideration.

CONCLUSION

The aforementioned description of the specific embodiments will so fully reveal the general nature of the disclosure that others can, by applying knowledge within the skill of the art, readily modify and/or adapt for various applications such specific embodiments, without undue experimentation, and without departing from the general concept of the present disclosure. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

References in the specification to "one embodiment," "an embodiment," "an exemplary embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The exemplary embodiments described herein are provided for illustrative purposes, and are not limiting. Other exemplary embodiments are possible, and modifications may be made to the exemplary embodiments. Therefore, the specification is not meant to limit the disclosure. Rather, the scope of the disclosure is defined only in accordance with the following claims and their equivalents.

REFERENCE LIST

1 printing system
2 recording medium
3 deflection roller
4 turner
5 first printing tower
6 first printing station
7 first drying station
8 second printing tower
9 second printing station
10 second drying station
11 first drying section
12 second drying section
13 first heater
14 first cooler
15 second heater
16 holder
17 first heating section
18 second heating section
19 transport device
20 takeup and/or further processing device
21 first cooling section
22 hot air element
23 cool air element
24 holding section
25 cooler
26 second cooling section
A first side
B second side
S1-S4 steps
Y, M, C, K color print bars

The invention claimed is:

1. A method for double-sided printing to a recording medium, comprising:

printing to a first side of the recording medium with a liquid first color separation;

pre-drying of the liquid first color separation to provide the first color separation in a pre-dried state, the pre-drying being configured such that a predetermined final drying state remains unachieved, wherein the pre-dried state is a transportable intermediate state that is between a wet print image directly after printing and the predetermined final drying state;

printing to a second side of the recording medium with a liquid second color separation; and jointly drying the first color separation in the pre-dried state and the liquid second color separation to entirely achieve the predetermined final drying state for both the first and second color separations.

2. The method according to claim 1, further comprising: following the pre-drying, transporting and/or deflecting the recording medium using a transport device, the pre-drying being configured to prepare the liquid first color separation to be touch-safe for a transport and/or deflection.

3. The method according to claim 2, wherein the transport device comprises one or more transport rollers and/or one or more deflection rollers.

4. The method according to claim 2, further comprising: turning the recording medium by a turner between the pre-drying and the printing to the second side, wherein the pre-drying is configured to prepare the first liquid color separation to be touch-safe for turning of the recording medium.

5. The method according to claim 1, further comprising: turning the recording medium by a turner between the pre-drying and the printing to the second side, wherein the pre-drying is configured to prepare the first liquid color separation to be touch-safe for the turning of the recording medium.

6. The method according to claim 1, wherein the predetermined final drying state is provided such that the first color separation and the second color separation may:

withstand handling by a takeup of the recording medium without damaging the first color separation and the second color separation, and/or withstand a further processing of the recording medium without damaging the first color separation and the second color separation.

7. The method according to claim 6, wherein the further processing of the recording medium comprises: cutting, folding, enveloping, and/or bookbinding of the recording medium.

8. The method according to claim 1, wherein:

the pre-drying of the first color separation comprises a heating of the recording medium to a predetermined minimum temperature, and the jointly drying of the pre-dried first color separation and the second color separation comprises a heating of the recording medium to a predetermined drying temperature, the predetermined minimum temperature being below the drying temperature.

9. The method according to claim 8, wherein the pre-drying further comprises cooling the recording medium to a temperature suitable for printing directly following the heating of the recording medium to the predetermined minimum temperature.

10. The method according to claim 8, wherein the jointly drying further comprises an intervening holding of the predetermined minimum drying temperature, or of a predetermined temperature profile, for a predetermined duration following the heating to the predetermined minimum drying temperature.

11. The method according to claim 1, wherein the printing to the first side, and/or the printing to the second side is performed by inkjet printing, and wherein the pre-drying and/or the jointly drying is performed by hot air flotation drying.

12. A non-transitory computer-readable storage medium with an executable program stored thereon, wherein, when executed, the program instructs a controller of a printing system to control the printing system to:

print to a first side of the recording medium with a liquid first color separation;

pre-dry the liquid first color separation to provide the first color separation in a pre-dried state, the pre-drying being configured such that a predetermined final drying state remains unachieved, wherein the pre-dried state is a transportable intermediate state that is between a wet print image directly after printing and the predetermined final drying state;

print to a second side of the recording medium with a liquid second color separation; and jointly dry the first color separation in the pre-dried state and the liquid second color separation to entirely achieve the predetermined final drying state for both the first and second color separations.

13. A device for double-sided printing to a recording medium, comprising:

a first printing tower including a first printing station configured to print to a first side of the recording medium with a first color separation, and a first drying station configured to pre-dry the first color separation to provide the first color separation in a pre-dried state such that a predetermined final drying state of the first color separation remains unachieved; and a second printing tower including a second printing station configured to print to a second side of the recording medium with a second color separation, and a second drying station configured to jointly dry the first color separation in the pre-dried state and the second color separation to entirely achieve the predetermined final drying state for both the first and second color separations.

14. The device according to claim 13, wherein the second drying station comprises a second drying section configured to be longer than a first drying section of the first drying station.

15. The device according to claim 13, wherein:

the first drying station comprises a first heater configured to heat the recording medium, and a cooler directly following the first heater and configured to cool the recording medium; and the second drying station comprises a second heater configured to heat the recording medium, and a subsequently positioned holder configured to hold a drying temperature, or a predetermined temperature profile, over a predetermined duration.

16. The device according to claim 15, wherein the first heater comprises a first heating section configured to be shorter than a second heating section of the second heater.

17. The device according to claim 13, further comprising a transport device configured to transport the recording medium from the first printing tower to the second printing tower, wherein the first drying station is configured such that the recording medium with the pre-dried first color separation is transportable via the transport device without compromising the first color separation.

18. The device according to claim 17, wherein the transport device comprises transport, drive, and/or deflection rollers with predetermined surface properties and, wherein the first drying station is configured to adapt the pre-drying to the predetermined surface properties such that the first color separation withstands transport to the second printing tower without damaging the first color separation.

19. The device according to claim 13, further comprising a takeup and/or further processing device following the second printing tower, wherein the predetermined drying state of the first color separation and second color separation is configured such that the recording medium:

withstands handing by a takeup without damaging the first color separation and the second color separation, and/or withstands a further processing of the recording medium without damaging the first color separation and the second color separation.

* * * * *